US010653194B1

(12) United States Patent
Kundlinger et al.

(10) Patent No.: US 10,653,194 B1
(45) Date of Patent: May 19, 2020

(54) HALF SHOE ACCESSORY FOR A FOOT BRACE BOOT

(71) Applicants: Philip Kundlinger, Hewitt, WI (US); Karen Kundlinger, Hewitt, WI (US)

(72) Inventors: Philip Kundlinger, Hewitt, WI (US); Karen Kundlinger, Hewitt, WI (US)

( * ) Notice: Subject to any disclaimer, the term of this patent is extended or adjusted under 35 U.S.C. 154(b) by 346 days.

(21) Appl. No.: 15/865,507

(22) Filed: Jan. 9, 2018

(51) Int. Cl.
*A41D 13/06* (2006.01)

(52) U.S. Cl.
CPC ..... *A41D 13/06* (2013.01)

(58) Field of Classification Search
CPC ..... A41D 13/06; A41D 13/065; A41D 13/08; A41D 13/088; A41D 13/015; A41D 13/0153; A41D 13/0543; A41D 13/0562; A41D 19/01; A41D 19/01523; A41D 27/12; A41D 27/26; A43B 3/20; A43B 3/22; A43B 7/1495; A43B 7/1405; A61F 5/0195; A61F 5/0111; A61F 5/0585; A61F 5/0127; A61F 15/00; A61F 15/008; A61F 5/30; A47L 13/18; A47L 13/282
USPC ..... 2/20, 22, 24; 36/136, 77 R, 71, 140; 602/27, 28, 29, 30, 3, 63, 65, 66, 78; 15/227, 209.1, 210.1; 128/894
See application file for complete search history.

(56) References Cited

U.S. PATENT DOCUMENTS 1,492,514 A * 4/1924 Jensen ..... A61F 13/065 602/66
3,407,406 A * 10/1968 Werner ..... A43B 19/00 2/413
D219,136 S * 11/1970 Mace ..... D2/913
3,583,704 A * 6/1971 Callanan ..... A63B 71/148 473/62
4,457,640 A * 7/1984 Anderson ..... A47K 7/03 15/104.94
4,494,536 A 1/1985 Latenser
4,495,942 A * 1/1985 Palumbo ..... A61F 13/066 602/27
5,138,777 A 8/1992 Darby
5,542,198 A * 8/1996 Famolare ..... A43B 5/00 36/114
5,545,129 A * 8/1996 Snook ..... A61F 5/0111 128/894
5,947,807 A * 9/1999 Overseth ..... A46B 7/04 451/359
6,083,185 A 7/2000 Lamont
(Continued)

FOREIGN PATENT DOCUMENTS

WO 9208382 A1 5/1992

*Primary Examiner* — Amy Vanatta
(74) *Attorney, Agent, or Firm* — Kyle A. Fletcher, Esq.

(57) ABSTRACT

The half shoe accessory for a foot brace boot is configured for use with a controlled motion boot. The controlled motion boot is further defined with an upper, a sole, a vamp a quarter, and a toe guard. The toe guard is a perimeter structure that: 1) protects the interior of the vamp section of the half shoe accessory for a foot brace boot from impact injuries; and, 2) follows the perimeter of the sole. The half shoe accessory for a foot brace boot comprises a sleeve, an impact cushion, and a plurality of hook and loop fasteners. The sleeve is a covering placed over the toe guard. The impact cushion is a pad that attaches to the superior side of the sleeve. The plurality of hook and loop fasteners: 1) attach the sleeve to the toe guard; and, 2) attach the impact cushion to the sleeve.

17 Claims, 5 Drawing Sheets

(56) References Cited

U.S. PATENT DOCUMENTS

| | | | | |
|---|---|---|---|---|
| 6,311,415 | B1 * | 11/2001 | Lind | A43B 5/00 36/130 |
| D454,640 | S | 3/2002 | Darby | |
| 6,464,659 | B1 * | 10/2002 | DeToro | A61F 5/0195 602/23 |
| 6,610,897 | B2 | 8/2003 | Cavanagh | |
| D489,518 | S * | 5/2004 | Maxfield | D2/919 |
| 7,798,984 | B2 | 9/2010 | Ponsi | |
| 7,981,069 | B2 | 7/2011 | Cimino | |
| 8,402,678 | B1 | 3/2013 | Kopelman | |
| D683,114 | S * | 5/2013 | Vardell | D2/909 |
| 8,578,941 | B2 | 11/2013 | Kaminski | |
| 8,959,801 | B1 * | 2/2015 | Siragusa, Jr. | A63B 71/1225 2/22 |
| D785,296 | S * | 5/2017 | Lucia | D2/896 |
| 2009/0038098 | A1 * | 2/2009 | Chareyron | A47L 13/18 15/227 |
| 2013/0283491 | A1 * | 10/2013 | Clement | A41D 13/0543 2/22 |
| 2013/0340293 | A1 * | 12/2013 | Lee | A43B 7/20 |
| 2014/0096779 | A1 | 4/2014 | Roggenkamp | |
| 2016/0193071 | A1 * | 7/2016 | Forsythe | A61F 5/32 128/888 |
| 2018/0352904 | A1 * | 12/2018 | Garzon | A43B 17/18 |

* cited by examiner

HALF SHOE ACCESSORY FOR A FOOT BRACE BOOT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science, more specifically, an accessory intended for use with an orthopedic device configured for use with the foot and ankle.

SUMMARY OF INVENTION

The half shoe accessory for a foot brace boot is configured for use with a controlled motion boot. The controlled motion boot is a medical device that is commonly referred to as a walking cast or a walking boot. The controlled motion boot is further defined with an upper and a sole. The upper is further defined with a vamp and a quarter. The vamp is further defined with a toe guard. The toe guard is a perimeter structure that: 1) protects the interior of the vamp section of the half shoe accessory for a foot brace boot from impact injuries; and, 2) forms a perimeter that follows along the perimeter of the sole. The half shoe accessory for a foot brace boot comprises a sleeve, an impact cushion, and a plurality of hook and loop fasteners. The sleeve is a covering placed over the toe guard. The impact cushion is a pad that attaches to the superior side of the sleeve. The plurality of hook and loop fasteners: 1) attach the sleeve to the toe guard; and, 2) attach the impact cushion to the sleeve.

These together with additional objects, features and advantages of the half shoe accessory for a foot brace boot will be readily apparent to those of ordinary skill in the art upon reading the following detailed description of the presently preferred, but nonetheless illustrative, embodiments when taken in conjunction with the accompanying drawings.

In this respect, before explaining the current embodiments of the half shoe accessory for a foot brace boot in detail, it is to be understood that the half shoe accessory for a foot brace boot is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the half shoe accessory for a foot brace boot.

It is therefore important that the claims be regarded as including such equivalent construction insofar as they do not depart from the spirit and scope of the half shoe accessory for a foot brace boot. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
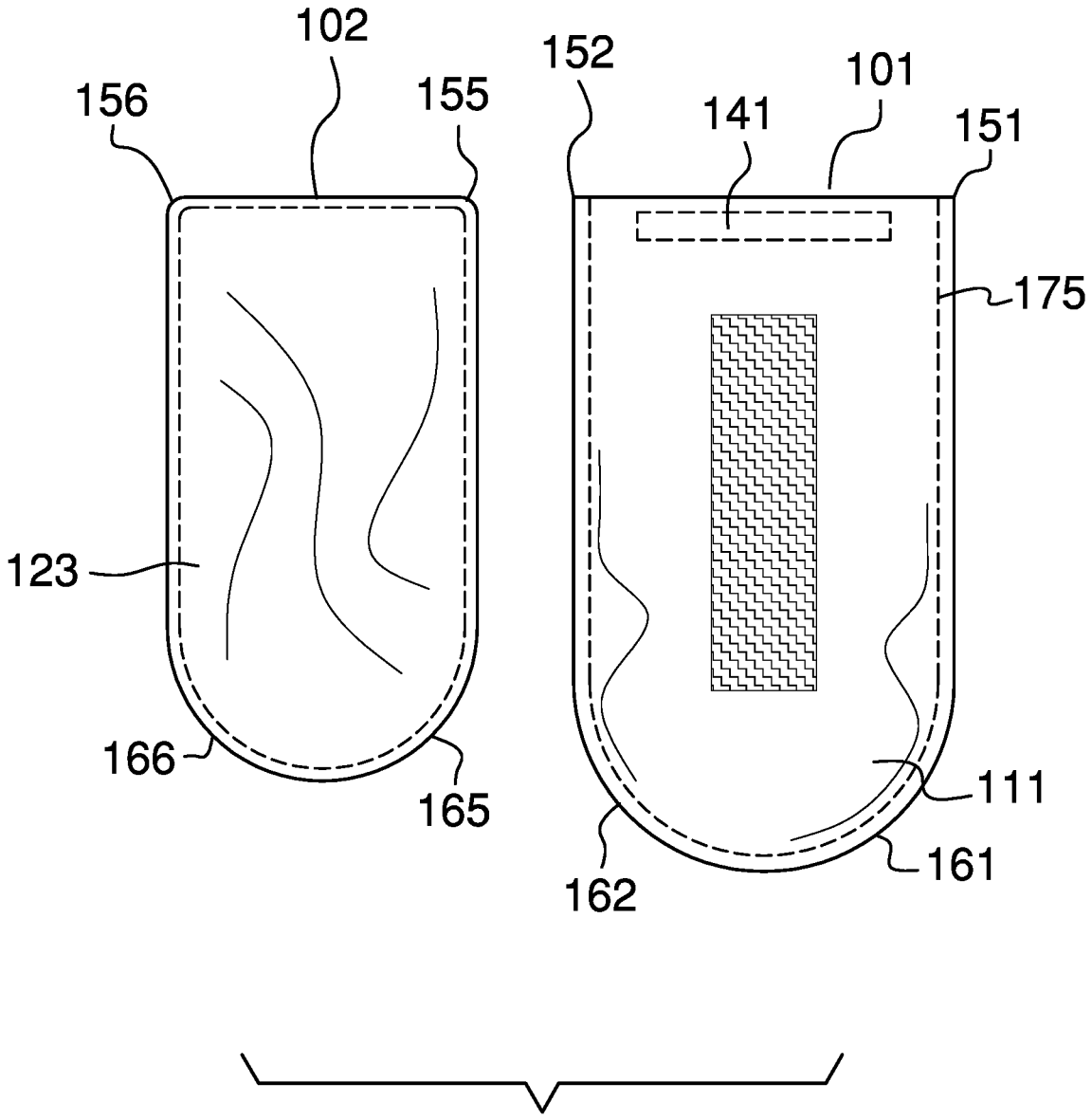
FIG. 1 is a top view of an embodiment of the disclosure.
Figure 2:
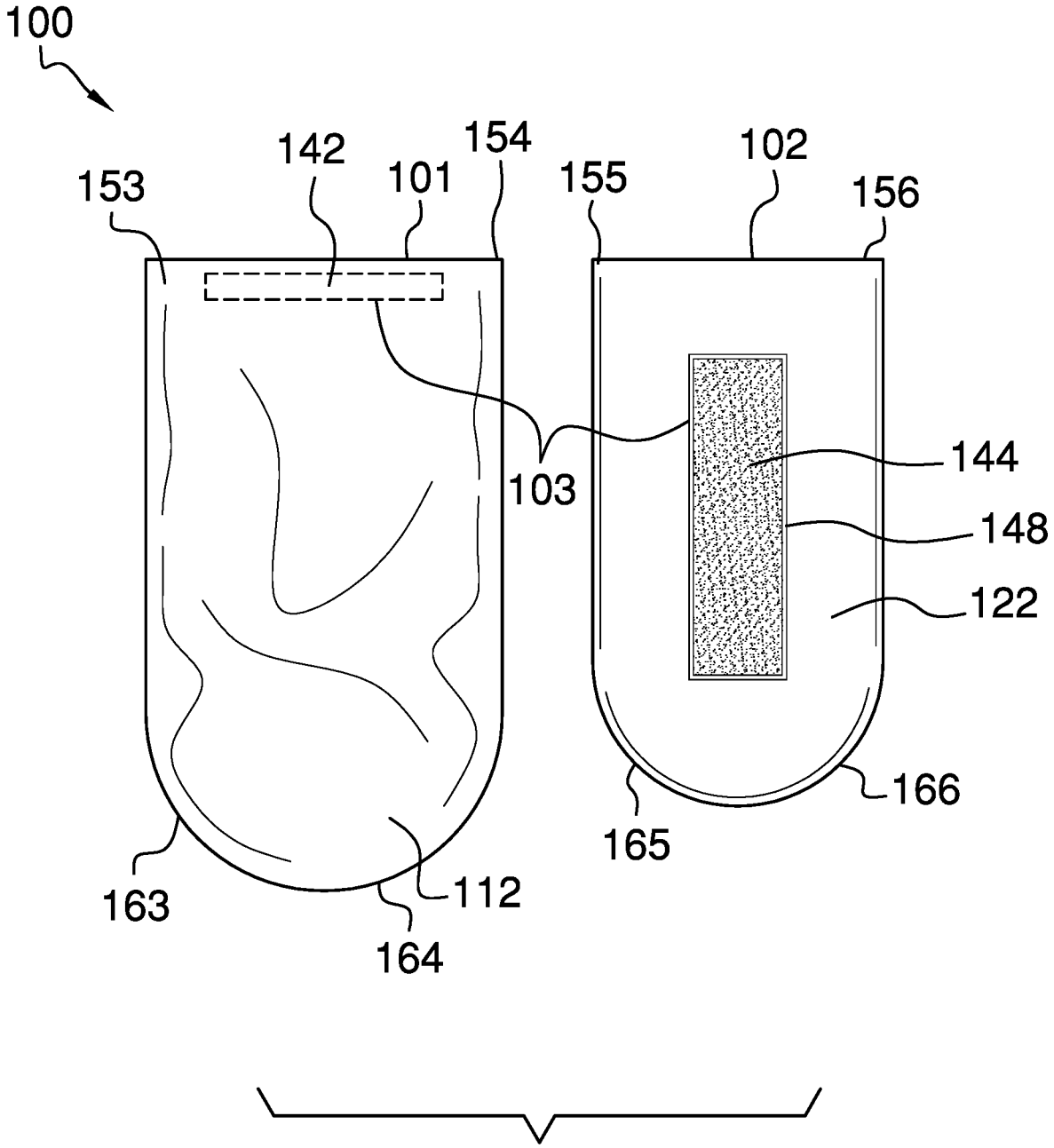
FIG. 2 is a bottom view of an embodiment of the disclosure.
Figure 3:
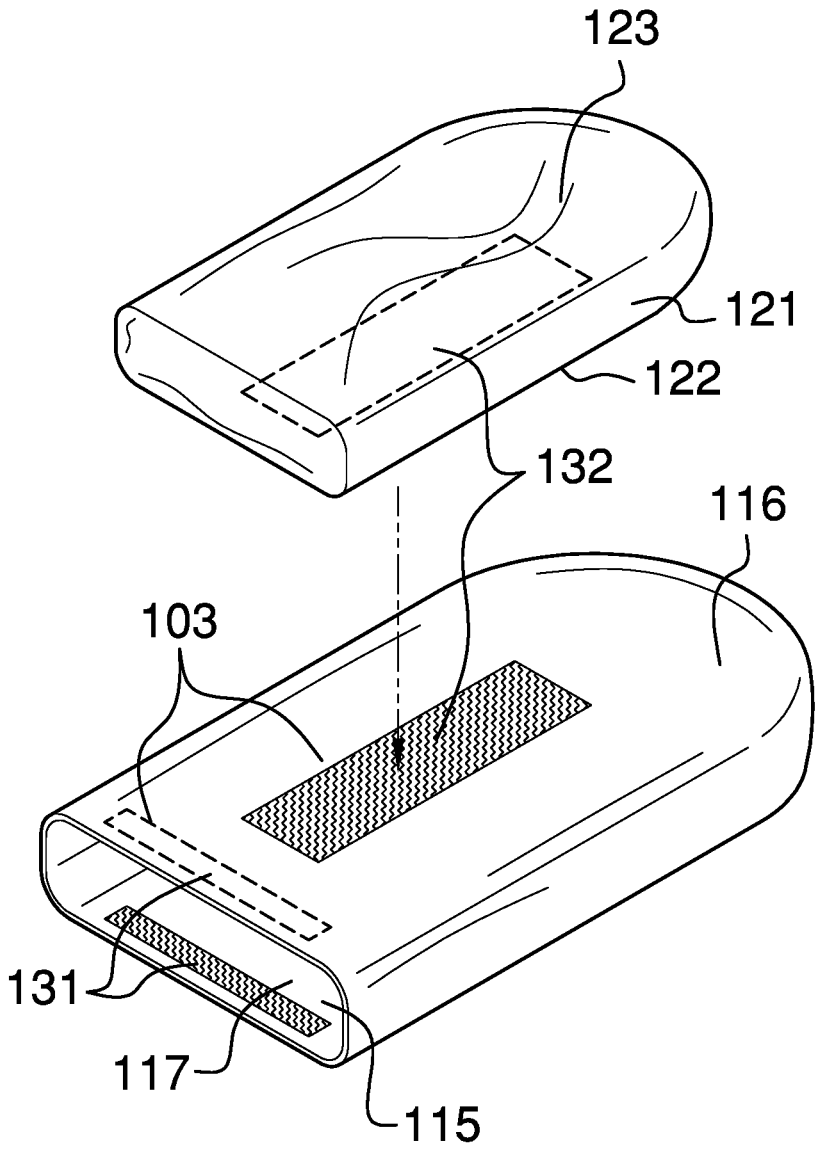
FIG. 3 is an exploded view of an embodiment of the disclosure.
Figure 4:
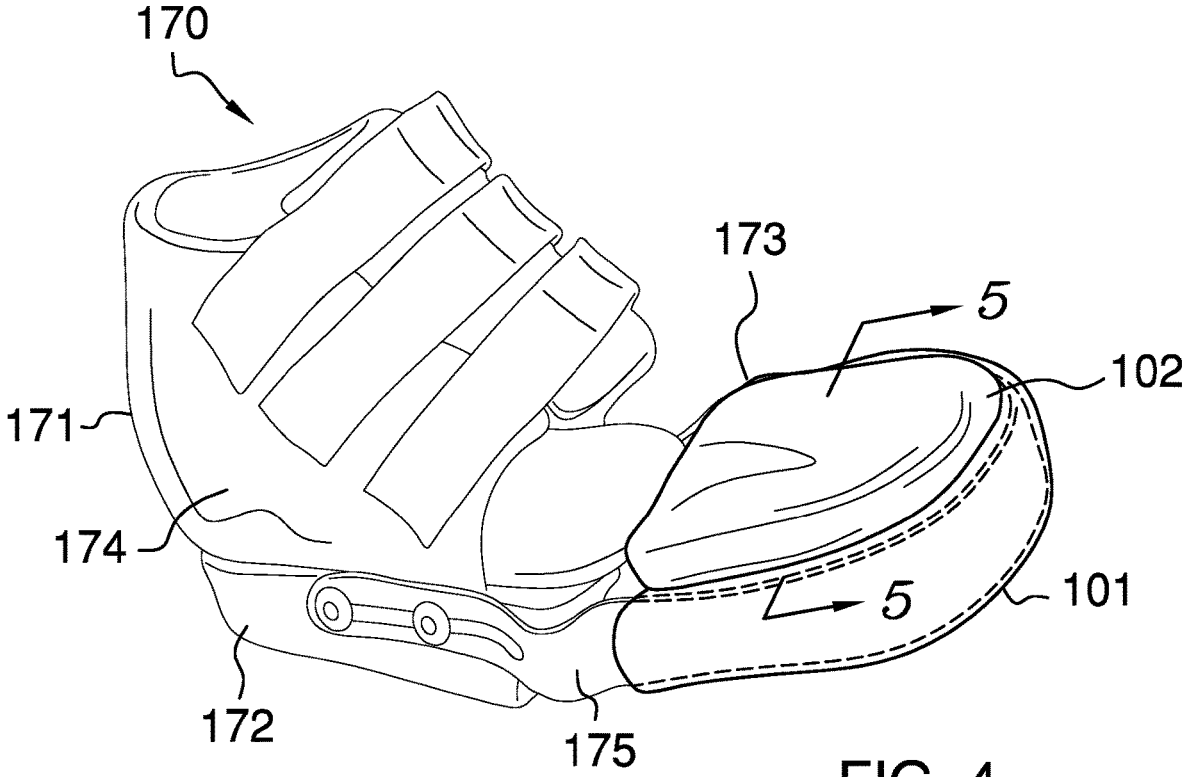
FIG. 4 is an in-use view of an embodiment of the disclosure.
Figure 5:
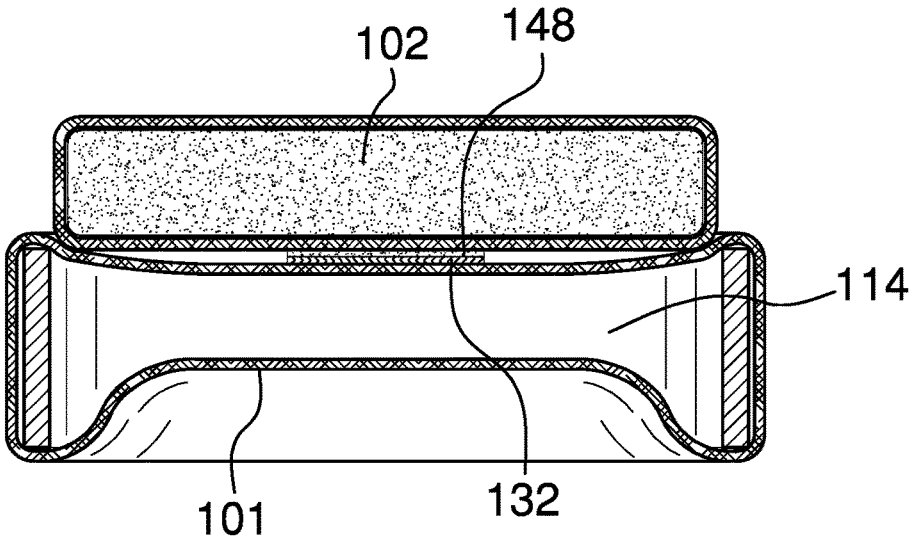
FIG. 5 is a cross-sectional view of an embodiment of the disclosure across 5-5 as shown in FIG. 4.
Figure 6:
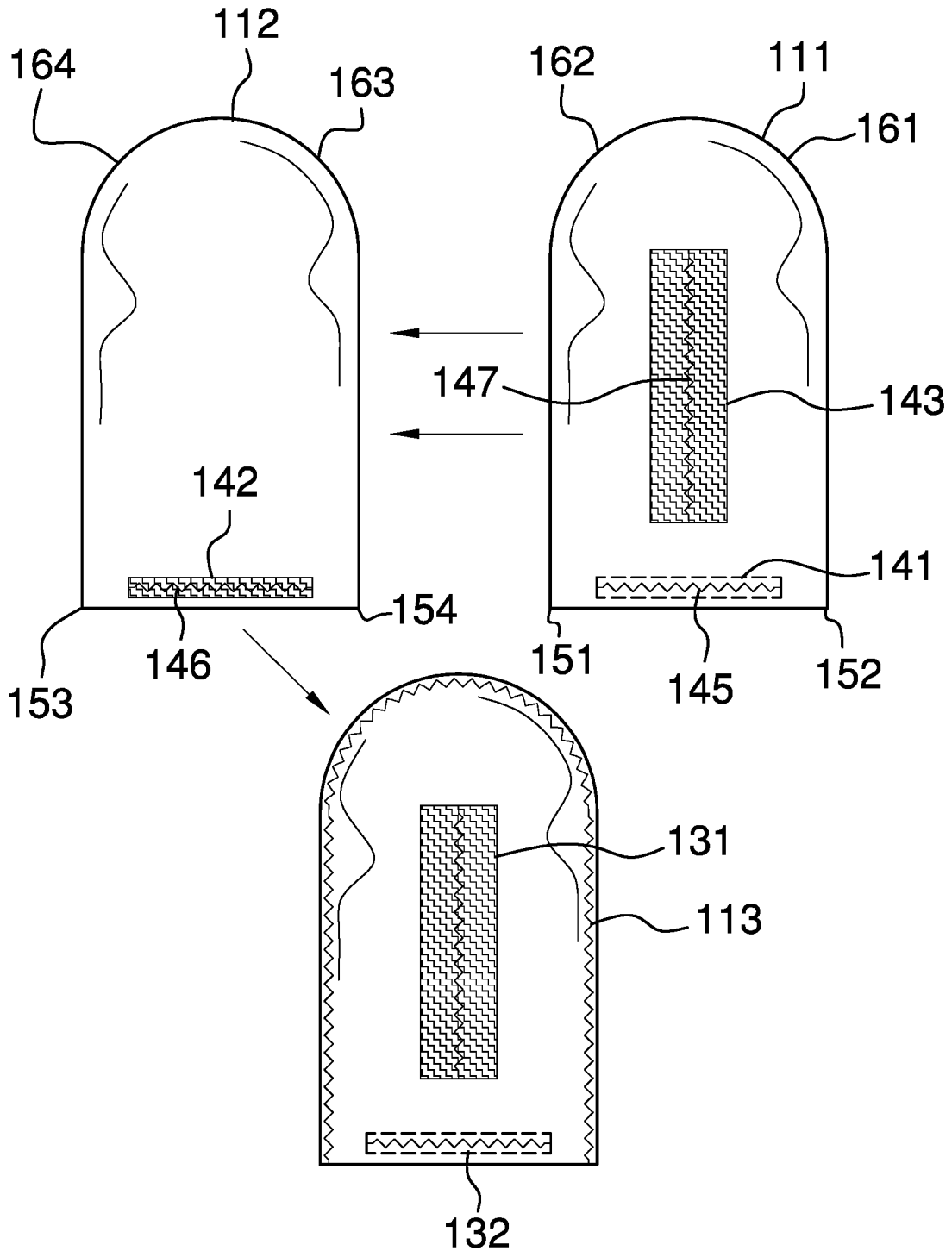
FIG. 6 is a detail view of an embodiment of the disclosure.

Detailed reference will now be made to one or more potential embodiments of the disclosure, which are illustrated in FIGS. 1 through 6.

The half shoe accessory for a foot brace boot 100 (hereinafter invention) is configured for use with a controlled motion boot 170. The controlled motion boot 170 is a medical device that is commonly referred to as a walking cast or a walking boot. The controlled motion boot 170 is further defined with an upper 171 and a sole 172. The upper 171 is further defined with a vamp 173 and a quarter 174. The vamp 173 is further defined with a toe guard 175. The toe guard 175 is a perimeter structure that: 1) protects the interior of the vamp 173 section of the invention 100 from impact injuries; and, 2) forms a perimeter that follows along the perimeter of the sole 172.

The invention 100 comprises a sleeve 101, an impact cushion 102, and a plurality of hook and loop fasteners 103. The sleeve 101 is a covering that is placed over the toe guard 175. The impact cushion 102 is a pad that attaches to the superior side of the sleeve 101. The plurality of hook and loop fasteners 103: 1) attach the sleeve 101 to the toe guard 175; and, 2) attach the impact cushion 102 to the sleeve 101.

The sleeve 101 is a protective sheath. The sleeve 101 slides over the toe guard 175. The sleeve 101: 1) provides a superior attachment surface to which the impact cushion 102 attaches; and, 2) protects the toe guard 175 from side impact damage. The sleeve 101 comprises a top sheeting 111, a bottom sheeting 112, and a fifth seam 113. The sleeve 101 is further defined with a containment space 114, an opening 115, an exterior surface 116, and an interior surface 117. The top sheeting 111 is further defined with a first corner 151, a second corner 152, a first rounded corner 161, and a second rounded corner 162. The bottom sheeting 112 is further defined with a third corner 153, a fourth corner 154, a third rounded corner 163, and a fourth rounded corner 164.

The top sheeting 111 is a sheeting that forms the superior boundary of the sleeve 101. The top sheeting 111 is geometrically similar to the perimeter formed by the toe guard 175. The top sheeting 111 protects the superior edge of the toe guard 175 of the controlled motion boot 170.

The bottom sheeting 112 is a sheeting that forms the inferior boundary of the sleeve 101. The bottom sheeting 112 protects the inferior edge of the toe guard 175 of the controlled motion boot 170. The bottom sheeting 112 is geometrically identical to the top sheeting 111.

The fifth seam 113 is a single seam that joins the top sheeting 111 to the bottom sheeting 112 to form the sheath of the sleeve 101.

The following three paragraphs describe how the fifth seam 113 joins the top sheeting 111 to the bottom sheeting 112.

The fifth seam 113 joins the first corner 151 to the third corner 153. The fifth seam 113 joins the second corner 152 to the fourth corner 154. The fifth seam 113 joins the first rounded corner 161 to the third rounded corner 163. The fifth seam 113 joins the second rounded corner 162 to the fourth rounded corner 164.

The fifth seam 113 joins the edge of the top sheeting 111 from the first corner 151 to the first rounded corner 161 to the edge of the bottom sheeting 112 from the third corner 153 to the third rounded corner 163. The fifth seam 113 joins the edge of the top sheeting 111 from the first rounded corner 161 to the second rounded corner 162 to the edge of the bottom sheeting 112 from the third rounded corner 163 to the fourth rounded corner 164. The fifth seam 113 joins the edge of the top sheeting 111 from the second rounded corner 162 to the second corner 152 to the edge of the bottom sheeting 112 from the fourth rounded corner 164 to the fourth corner 154.

In the first potential embodiment of the disclosure, the fifth seam 113 is a sewn seam.

The containment space 114 refers to the interior volume formed within the sleeve 101 that contains the toe guard 175. The interior surface 117 of the containment space 114 is bounded by the space between the top sheeting 111 and the bottom sheeting 112. The exterior surface 116 is the surface of the sleeve 101 that is distal from the interior surface 117.

The opening 115 is an access port. The opening 115 controls access into the containment space 114 of the sleeve 101. The opening 115 is formed between: 1) the joint formed by the first corner 151 and the third corner 153; and, 2) the joint formed by the second corner 152 and the fourth corner 154.

The impact cushion 102 is a padding material. The impact cushion 102 protects objects contained in the interior volume of the controlled motion boot 170 from impact damage. The impact cushion 102 comprises a padding 121. The padding 121 is further defined with an inferior surface 122 and a superior surface 123. The padding 121 is further defined with a fifth corner 155, a sixth corner 156, a fifth rounded corner 165, and a sixth rounded corner 166.

The padding 121 is a foam cushion. The padding 121 attaches to the exterior surface 116 of the top sheeting 111 such that the padding 121 protects the superior boundary of the controlled motion boot 170 that is over the vamp 173 of the controlled motion boot 170. In the first potential embodiment of the disclosure, the padding 121 is formed from a polymer foam selected from the group consisting of a polyurethane-based foam and a polychloroprene (CAS 9010-98-4) based foam. The shape of the padding 121 is geometrically similar to the shape of the toe guard 175 such that the padding 121 will fit flush within the interior of the perimeter formed by the toe guard 175. The inferior surface 122 is the surface of the padding 121 that attaches to the top sheeting 111 of the sleeve 101. The superior surface 123 is the surface of the padding 121 that is distal from the inferior surface 122.

Each of the plurality of hook and loop fasteners 103 is a commercially available fastener. The plurality of hook and loop fasteners 103: 1) attach the impact cushion 102 to the sleeve 101 such that the impact cushion 102 protects the superior boundary of the controlled motion boot 170; and, 2) attaches the sleeve 101 to the toe guard 175 of the controlled motion boot 170. The plurality of hook and loop fasteners 103 comprises a first hook and loop fastener 131 and a second hook and loop fastener 132. The first hook and loop fastener 131 comprises a first hook/loop surface 141, a second hook/loop surface 142, a first seam 145, and a second seam 146. The second hook and loop fastener 132 comprises a third hook/loop surface 143, a fourth hook/loop surface 144, a third seam 147, and a fourth seam 148.

The first hook and loop fastener 131 is a hook and loop fastener. The first hook and loop fastener 131 secures the sleeve 101 to the toe guard 175. The first hook and loop fastener 131 attaches the top sheeting 111 to the bottom sheeting 112. Specifically, the first hook and loop fastener 131 attaches: 1) the span of the perimeter of the top sheeting 111 from the first corner 151 to the second corner 152; to the, 2) the span of the perimeter of the bottom sheeting 112 from the third corner 153 to the fourth corner 154.

The second hook and loop fastener 132 is a hook and loop fastener. The second hook and loop fastener 132 secures the impact cushion 102 to the sleeve 101. Specifically, the second hook and loop fastener 132 attaches the inferior surface 122 from the padding 121 to the exterior surface 116 of the top sheeting 111.

The first hook/loop surface 141 is the surface of the first hook and loop fastener 131 attached to the interior surface 117 of the top sheeting 111. The first seam 145 attaches the first hook/loop surface 141 to the edge of the top sheeting 111 between the first corner 151 and the second corner 152. The first seam 145 is a sewn seam. The second hook/loop surface 142 is the surface of the first hook and loop fastener 131 attached to the interior surface 117 of the bottom sheeting 112. The second seam 146 attaches the second hook/loop surface 142 to the edge of the bottom sheeting 112 between the third corner 153 and the fourth corner 154. The second seam 146 is a sewn seam.

The third hook/loop surface 143 is the surface of the second hook and loop fastener 132 attached to the exterior surface 116 of the top sheeting 111. The third seam 147 attaches the third hook/loop surface 143 to the center of the exterior surface 116 of the top sheeting 111. The third seam 147 is a sewn seam. The fourth hook/loop surface 144 is the surface of the second hook and loop fastener 132 attached to the inferior surface 122 of the padding 121. The fourth seam 148 attaches the fourth hook/loop surface 144 to the center of the inferior surface 122 of the padding 121. The fourth seam 148 is positioned such that the center of the padding 121 and the center of the top sheeting 111 are aligned with the force of gravity when the impact cushion 102 attaches to the sleeve 101. The fourth seam 148 is an adhesive seam.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a structure formed with a pad that is used to prevent injury or damage to a person or object.

Duration: As used in this disclosure, a duration refers to the measure of the passage of time between two or more events.

Exterior: As used in this disclosure, the exterior is used as a relational term that implies that an object is not contained within the boundary of a structure or a space.

Flush: As used in this disclosure, the term flush is used to describe the alignment of a first surface and a second surface on a single plane Foam: As used in this disclosure, a foam is a mass of gas-filled spaces, commonly referred to as bubbles, which can be formed: 1) on or in a liquid or gel; or, 2) in a solid material.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Impact: As used in this disclosure, an impact refers to an exchange of momentum between two objects over a duration. An impact often refers to a collision between two objects Inferior: As used in this disclosure, the term inferior refers to a directional reference that is parallel to and in the same direction as the force of gravity.

Interior: As used in this disclosure, interior is used as a relational term that implies that an object is contained within the boundary of a structure or a space.

Neoprene: As used in this disclosure, neoprene is a popular name for polychloroprene (CAS 9010-98-4). One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Posterior: As used in this disclosure, posterior is a term that is used to refer to the side of a human body that is distal from the anterior side. When comparing two objects, the posterior object is the object that is distal from the anterior side of the human body.

Quarter: As used in this disclosure, the quarter is the portion of the upper that is connected to the vamp and that surrounds the heel and the sides of the foot.

Rectangular Block: As used in this disclosure, a rectangular block refers to a three-dimensional structure comprising six rectangular surfaces formed at right angles. Within this disclosure, a rectangular block may further comprise rounded edges and corners.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Sheeting: As used in this disclosure, a sheeting is a material, such as a textile, a plastic, or a metal foil, in the form of a thin flexible layer or layers.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheath: As used in this disclosure, a sheath is a shell that is used to cover an object and from which the object may be inserted and withdrawn.

Sleeve: As used in this disclosure, a sleeve is a tube-like covering placed over a rod, shaft or other cylindrical object.

Superior: As used in this disclosure, the term superior refers to a directional reference that is parallel to and in the opposite direction of the force of gravity.

Supporting Surface: As used in this disclosure, a supporting surface is a horizontal surface upon which an object is placed and to which the load path of the object is transferred. Within this disclosure, it is assumed that the object is placed on the supporting surface in an orientation that is appropriate for the normal or anticipated use of the object.

Upper: As used in this disclosure, the upper is the portion of the shoe that is above the sole.

Vamp: As used in this disclosure, the vamp is the portion of the upper that covers the upper portion of the foot from the toes to where the vamp connects to the quarter.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An accessory for an orthopedic device comprising:

a sleeve, an impact cushion, and a plurality of hook and loop fasteners;

wherein the impact cushion is a pad that attaches to a superior side of the sleeve;

wherein the plurality of hook and loop fasteners attach the impact cushion to the sleeve;

wherein the accessory for an orthopedic device is configured for use with a controlled motion boot;

wherein the controlled motion boot is further defined with an upper and a sole;

wherein the upper is further defined with a vamp and a quarter;

wherein the vamp is further defined with a toe guard;

wherein the toe guard is separated from the sole of the controlled motion boot;

wherein the sleeve is a covering;

wherein the plurality of hook and loop fasteners are configured to attach the sleeve to the toe guard;

wherein the plurality of hook and loop fasteners comprises a first hook and loop fastener and a second hook and loop fastener;

wherein the first hook and loop fastener further comprises a first hook/loop surface, a second hook/loop surface, a first seam, and a second seam;

wherein the second hook and loop fastener comprises a third hook/loop surface, a fourth hook/loop surface, a third seam, and a fourth seam;

wherein the sleeve comprises a top sheeting, a bottom sheeting, and a fifth seam;

wherein the fifth seam attaches the top sheeting to the bottom sheeting;

wherein the sleeve is further defined with a containment space, an opening, an exterior surface, and an interior surface;

wherein the top sheeting is further defined with a first corner, a second corner, a first rounded corner, and a second rounded corner;

wherein the bottom sheeting is further defined with a third corner, a fourth corner, a third rounded corner, and a fourth rounded corner;

wherein the first hook and loop fastener attaches the span of the perimeter of the top sheeting from the first corner to the second corner to the span of the perimeter of the bottom sheeting from the third corner to the fourth corner.

2. The accessory for an orthopedic device according to claim 1 wherein the sleeve is a protective sheath;

wherein the sleeve is configured to slide over the toe guard;

wherein the plurality of hook and loop fasteners attach the impact cushion to the sleeve;

wherein the plurality of hook and loop fasteners are configured to attach the sleeve to the toe guard of the controlled motion boot.

3. The accessory for an orthopedic device according to claim 2 wherein the top sheeting is a sheeting;

wherein the top sheeting forms a superior boundary of the sleeve;

wherein the bottom sheeting is a sheeting that forms the inferior boundary of the sleeve;

wherein the bottom sheeting is geometrically identical to the top sheeting.

4. The accessory for an orthopedic device according to claim 3 wherein the containment space is an interior volume formed within the sleeve;

wherein the interior surface of the containment space is bounded by the space between the top sheeting and the bottom sheeting;

wherein the exterior surface is the surface of the sleeve that is distal from the interior surface.

5. The accessory for an orthopedic device according to claim 4 wherein the fifth seam is a single seam;

wherein the fifth seam joins the first corner to the third corner;

wherein the fifth seam joins the second corner to the fourth corner;

wherein the fifth seam joins the first rounded corner to the third rounded corner;

wherein the fifth seam joins the second rounded corner to the fourth rounded corner;

wherein the fifth seam joins an edge of the top sheeting from the first corner to the first rounded corner to an edge of the bottom sheeting from the third corner to the third rounded corner;

wherein the fifth seam joins an edge of the top sheeting from the first rounded corner to the second rounded corner to an edge of the bottom sheeting from the third rounded corner to the fourth rounded corner;

wherein the fifth seam joins an edge of the top sheeting from the second rounded corner to the second corner to an edge of the bottom sheeting from the fourth rounded corner to the fourth corner.

6. The accessory for an orthopedic device according to claim 5 wherein the fifth seam is a sewn seam.

7. The accessory for an orthopedic device according to claim 6 wherein the opening is an access port into the containment space;

wherein the opening is formed between: A) a joint formed by the first corner and the third corner; and, B) a joint formed by the second corner and the fourth corner.

8. The accessory for an orthopedic device according to claim 7 wherein the impact cushion comprises a padding;

wherein the padding is a foam padding;

wherein the padding is further defined with an inferior surface and a superior surface.

9. The accessory for an orthopedic device according to claim 8 wherein the padding attaches to the exterior surface of the top sheeting such that the padding protects the superior boundary of the controlled motion boot that is over the vamp of the controlled motion boot.

10. The accessory for an orthopedic device according to claim 9 wherein the padding comprises a polymer foam selected from the group consisting of a polyurethane-based foam and a polychloroprene (CAS 9010-98-4) based foam.

11. The accessory for an orthopedic device according to claim 9 wherein the first hook and loop fastener is a hook and loop fastener;

wherein the first hook and loop fastener is configured to secure the sleeve to the toe guard;

wherein the second hook and loop fastener secures the impact cushion to the sleeve.

12. The accessory for an orthopedic device according to claim 11 wherein the second hook and loop fastener attaches the inferior surface from the padding to the exterior surface of the top sheeting.

13. The accessory for an orthopedic device according to claim 12 wherein the first hook/loop surface is the surface of the first hook and loop fastener attached to the interior surface of the top sheeting;

wherein the first seam attaches the first hook/loop surface to the edge of the top sheeting between the first corner and the second corner;

wherein the second hook/loop surface is the surface of the first hook and loop fastener attached to the interior surface of the bottom sheeting;

wherein the second seam attaches the second hook/loop surface to the edge of the bottom sheeting between the third corner and the fourth corner.

14. The accessory for an orthopedic device according to claim 13 wherein the third hook/loop surface is the surface of the second hook and loop fastener attached to the exterior surface of the top sheeting;

wherein the third seam attaches the third hook/loop surface to the center of the exterior surface of the top sheeting;

wherein the fourth hook/loop surface is the surface of the second hook and loop fastener attached to the inferior surface of the padding;

wherein the fourth seam attaches the fourth hook/loop surface to the center of the inferior surface of the padding.

15. The accessory for an orthopedic device according to claim 14 wherein the fourth seam is positioned such that the center of the padding and the center of the top sheeting are aligned with the force of gravity when the impact cushion attaches to the sleeve.

16. The accessory for an orthopedic device according to claim 15 wherein the first seam is a sewn seam;

wherein the second seam is a sewn seam;

wherein the third seam is a sewn seam;

wherein the fourth seam is an adhesive seam.

17. The accessory for an orthopedic device according to claim 16 wherein the padding comprises a polymer foam selected from the group consisting of a polyurethane-based foam and a polychloroprene (CAS 9010-98-4) based foam.

* * * * *